US007108106B2

(12) United States Patent
Kostka

(10) Patent No.: US 7,108,106 B2
(45) Date of Patent: Sep. 19, 2006

(54) CONTROL FOR ALLOCATING MAIN FLOOR DESTINATION CALLS TO MULTIPLE DECK ELEVATOR

(75) Inventor: Miroslav Kostka, Ballwil (CH)

(73) Assignee: Inventio AG, Hergiswil (CH)

( * ) Notice: Subject to any disclaimer, the term of this patent is extended or adjusted under 35 U.S.C. 154(b) by 314 days.

(21) Appl. No.: 10/701,204

(22) Filed: Nov. 4, 2003

(65) Prior Publication Data

US 2004/0089504 A1 May 13, 2004

(30) Foreign Application Priority Data

Nov. 6, 2002 (EP) ..... 02405952

(51) Int. Cl.
*B66B 1/34* (2006.01)

(52) U.S. Cl. ..... 187/391; 187/396; 187/902

(58) Field of Classification Search ..... 187/380–389, 187/902, 391–396

See application file for complete search history.

(56) References Cited

U.S. PATENT DOCUMENTS

| | | | | |
|---|---|---|---|---|
| 4,836,336 | A * | 6/1989 | Schroder | 187/384 |
| 5,086,883 | A | 2/1992 | Schroder | |
| 5,861,587 | A | 1/1999 | Powell et al. | |
| 6,176,351 | B1 * | 1/2001 | Ikeda et al. | 187/387 |
| 6,401,874 | B1 * | 6/2002 | Siikonen | 187/382 |
| 6,419,051 | B1 * | 7/2002 | Mori et al. | 187/382 |
| 6,505,712 | B1 * | 1/2003 | Hattori et al. | 187/382 |
| 6,619,437 | B1 * | 9/2003 | Hikita | 187/383 |

FOREIGN PATENT DOCUMENTS

| | | |
|---|---|---|
| EP | 0 301 178 | 2/1989 |
| EP | 0 624 540 | 11/1994 |
| EP | 1 193 207 | 4/2002 |
| JP | 07 309539 | 11/1995 |
| JP | 09 309539 | 11/1995 |
| JP | 10 194610 | 7/1998 |
| JP | 3 073 650 | 8/2000 |

* cited by examiner

*Primary Examiner*—Jonathan Salata
(74) *Attorney, Agent, or Firm*—Butzel Long

(57) ABSTRACT

A device for controlling a elevator installation with multiple deck cars which are simultaneously accessible at a main stopping point by different main stopping floors includes a call registering device by which a passenger can input a destination floor. In order to enable a more rapid filling of the building, a conversion unit responds to the destination call travel orders already allocated to and/or demanded of the multiple car having the deck which is to be allocated to the passenger to minimize the number of stops of the car. An indicating device indicates to the passenger the allocated car deck and/or the main stopping floor thereof.

18 Claims, 3 Drawing Sheets

CONTROL FOR ALLOCATING MAIN FLOOR DESTINATION CALLS TO MULTIPLE DECK ELEVATOR

BACKGROUND OF THE INVENTION

The present invention relates to a control device for an elevator installation having a plurality of cars serving multiple floors simultaneously, and a method for controlling such an elevator installation.

An elevator installation having double cars includes a control that permits the upper as well as the lower cars to be used at a main floor for travel to both even-numbered and odd-numbered floors is shown in U.S. Pat. No. 5,086,883.

All modern controls for elevator installations with multiple cars, for example double cars (double-deckers), strive for minimization of the number of stops and thus also the cycle or travel time. In the case of double-decker controls, the embarking and disembarking persons at two adjacent floors can be served, as far as possible, simultaneously. In order to fulfil this task, in the case of buildings equipped with multiple car elevators, for example double-decker elevators, two zones have to be separately considered:

Zone a) The main stopping point, i.e. usually the building entrance (lobby). The main stopping point comprises in correspondence with the car deck number of the multiple cars at least two, usually the two lowermost, stopping point floors. The main stops of the main stopping point (lobby) are usually connected by escalators. There thousands of passengers flow into and out of the building on a daily basis. For the elevator control the most important feature here is the same elevator position at the stop: the lowermost deck stops at the lowermost main stop floor of the main stopping point, thus as a rule the lobby.

Zone b) The other floors, thus, for example, the upper floors above the main stopping point. There the multiple car elevators, for example double-decker elevators, are so controlled in the case of between-floor traffic with advantage that they simultaneously serve those two adjacent floors where passengers embark or disembark. The passenger waiting on such a floor accordingly cannot select the deck by which he or she is conveyed.

Known control algorithms—see, for example, the algorithm shown in EP 1 193 207—offer solutions for the zone b) optimized to a greater or lesser extent. The proposed invention fully optimizes the control for journeys from the zone a).

For "filling" of the building in good time it is important that the elevators starting from the main stopping point avoid "overlapping" stops (for example, floors 13/14 and then floors 14/15). This problem was previously solved (see, for example, EP 0 301 178) in such a manner that on the lower main stopping floor only the passengers with uneven floor destinations embark and in the upper floor those with destinations to even floors embark. This regulation applied not only for classical two-button controls, but also for new destination call controls.

Other solution possibilities were also proposed. Thus, in EP 0 624 540 a feasible elevator allocation by "preliminary information " from the passenger is proposed. On entry into the elevators the passenger selects one of the channels, wherein each channel is associated with a floor zone. The individual zones here consist of several floors.

The U.S. Pat. No. 5,086,883 mentioned above describes another solution for a destination call control. An elevator installation comprising a double-deck elevator group is selectably subdivided so that approximately half the elevators belong to the subgroup even/uneven and the second subgroup to uneven/even. The multiple cars are thus controlled in dependence on the divisibility of the number of the destination floor by the number of car decks per multiple car. Thus, every passenger at the two lobby floors should be spared use of the escalator, because an elevator can always be allocated to him or her independently of the evenness or unevenness of the destination floor. The individual multiple cars are, however, in that case always controlled with the so-called "restricted service", i.e. one of the car decks always stops at an even-numbered floor and the other at an uneven-numbered floor. The allocation of the passenger by his determined travel call, indicated by his or her destination call, to a car deck actually serving the even floors or to a car deck actually serving the uneven floors is also carried out in corresponding manner.

The known solutions have a few disadvantages—the passenger has to at least know what even and uneven mean or then in which zone his or her destination floor is located. In the case of the zone channels a regular building user cannot develop a behavioral stereotype with the same elevator group, because possibly different channels have to be used for different destinations. In addition, the apparently elegant solution of subdivision of the elevator group into even/uneven and uneven/even subgroups conceals the disadvantage that the waiting times for some passengers are significantly increased.

The greatest problem arises when the floor designations in the building do not correspond with the numbering of the possible stops of the elevators. In such a case the decision of the passenger with regard to the evenness/unevenness of his or her destination floor (generally divisibility of the destination floor number by the car deck number) does not correspond with that which the control considers on the basis of the number of possible stopping point pairs (stopping point triples in the case of triple cars, etc.). This problem can also arise as soon as the elevator group has blind zones or express zones (i.e. floors which are not served). Sometimes even several blind zones of different length are present and thus the selection of the most favorable stopping point pairs with respect to even/uneven or uneven/even can change several times.

The object of the present invention is to improve a control device, an elevator installation, and a building in such a manner that the building filling takes place more quickly with elevator passengers starting from the main stopping point.

SUMMARY OF THE INVENTION

For control of the operation with respect to the above-mentioned zone a), a significant improvement is achieved for the destination call control at the main stopping point with the solution according to the present invention. In accordance with the present invention, the control uses a dynamic conversion unit. Advantageously the conversion unit is adapted to the building layout.

The conversion unit or the control steps which it can perform assist the deck allocation and preferably also the elevator allocation in the case of an elevator group in such a manner that each elevator in the case of distribution travel starting out from the main stopping point, for example the lobby, selects only the non-overlapping stops and correspondingly allocates the passengers to the most suitable deck (and elevator). Thus the cycle times are reduced, transport capacity increased and waiting times shortened. The passenger selects his or her destination floor, and the allocated deck (in that case also the lower or upper lobby)—and optionally also the allocated elevator—is immediately indicated to him or her on the indicating device, for example a display, at the destination call registration device.

The advantage relative to the previous solutions is that the passenger does not have to make any decision about the evenness/unevenness (or other divisibility by the number of the car decks) of his or her destination floor. Such a decision could possibly be counter-productive. A further advantage is to be seen in the fact that particularly in the case of "traffic peaks during the upward peak traffic " the passengers are optimally distributed to all decks and, in a given case, elevators.

The designation "dynamic " signifies according to the preferred form of embodiment that there is no statistical allocation of car decks of individual elevators to a specific floor group (for example even/uneven) during an elevator journey. The conversion unit can thus not only solve the problem of an inconsistency between the floor designation in the building and a stop number numeration within the control, but according to a respective situation also permits grouping of passengers with even and uneven destinations in one deck. In correspondence with the function of the conversion unit to optimally process traffic peaks in the case of (upward) journeys starting from the lobby or like main stopping point these could also be differently denoted, for example SUPU (Super Up Peak Unit).

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
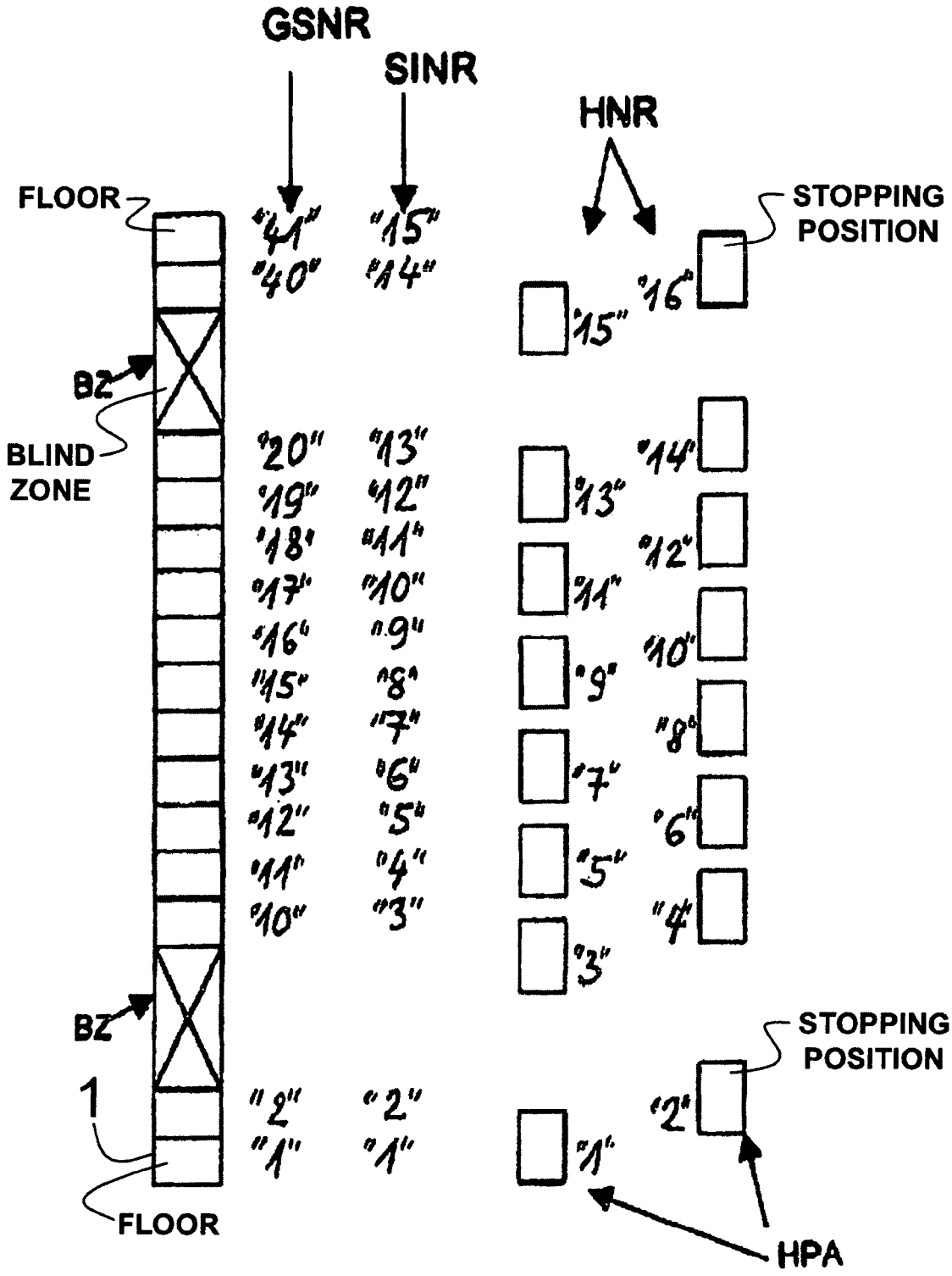
FIG. 1 is a schematic illustration of an elevator shaft of an elevator installation in a building, wherein the elevator installation serves floors of different height and express or blind zones, as well as a multiple car in the form of a double-deck car with two car decks disposed one above the other, wherein the numeration of the floors, a numeration carried out within the control and a numeration of the possible stops of the double-deck car are compared in different columns alongside one another.

In the description which follows here as well as in the drawings the numberings of floors or stops are placed in quotes on each occasion in order to distinguish them from the reference numerals.

FIG. 1 shows on the left an elevator shaft 1 in which the respective floors to be served by an elevator with a double-deck car 4 are indicated. The respective building floor number GSNR is indicated alongside at the right in a first column. A possible floor numeration SINR internal to the control is indicated alongside further to the right. Respective stopping positions HPA of the double-deck car 4 (see FIG. 3) are illustrated in a further column and provided with a possible stop numbering HNR. It may be assumed that the corresponding elevator does not serve the floors "3" to "9" and "21" to "39". These floors thus form the blind zones BZ or express zones through which the elevator can pass in rapid travel.

The problem of different numbering of the floors of the "building side" and "control internal" on the other hand is illustrated in FIG. 1. With consideration of the illustration in FIG. 1 it is apparent that virtually every physical level in the building can be denoted by several numbers. For example, the building floor "40" (this is also known as such to the passenger) is only the fourteenth stopping point (SINR) which is served as seen from the control, but then is the fifteenth or sixteenth possible stopping point (HNR) of the double-deck car 4. This has to be taken into consideration by the control. It is apparent from the drawing that the association of a lower car deck 5 (FIG. 3) with an uneven floor and an upper car deck 6 with an even floor is not always practicable. Thus, for example, in the case of a destination call to the building floor "10" (GSNR) the double car 4 stops with the lower car deck 5 in the blind zone BZ of the floor "9" which is not served.

Figure 2B:
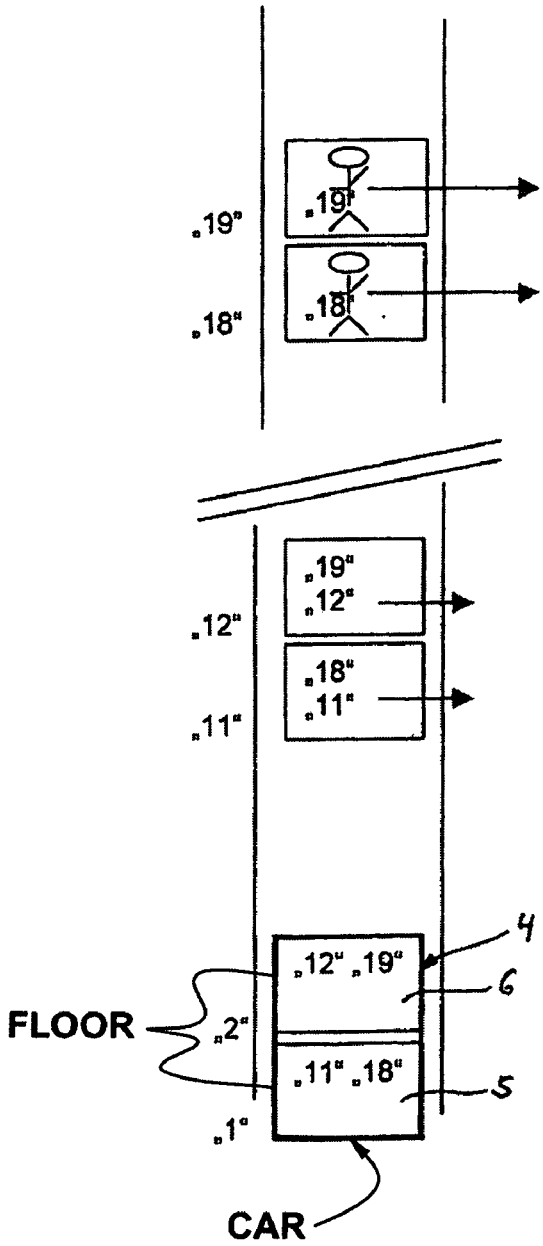
FIG. 2B is a schematic illustration of an elevator shaft of an elevator installation with a double-deck car and the stopping positions for execution of the same travel orders as in FIG. 2A, but in the case of the control according to the present invention.
Figure 2A:
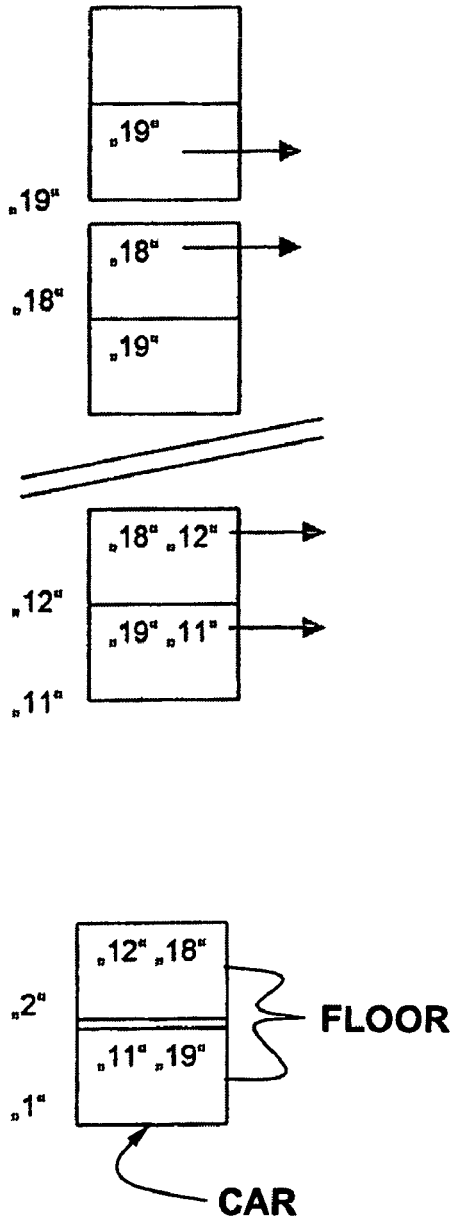
Fig. 2A (PRIOR ART)
FIG. 2A is a schematic illustration of the possible stopping positions of a double-deck car in the case of a journey, which starts from a main stopping point, with an elevator control according to the state of the art.

Schematic illustrations of an elevator shaft are shown in FIGS. 2A and 2B. There are illustrated the positions of the double car 4 during a distribution travel in the case of upward peak traffic that could happen. For a better overview in both cases only four passengers with, in both cases, the same travel desires are considered.

FIG. 2A shows the previously known solution with a so-called "restricted service"(even/uneven decision). It is assumed that the passengers would like to travel from the double-deck lobby forming the main stopping points HH (floors "1" and "2" form the main stopping floors) to the floors "11", "12", "18" and "19". Different stopping positions of the double car of an elevator according to the state of the art during processing of travel orders are shown in FIG. 2A. It may thus be assumed that passengers with the destination floors "11", "12", "18" and "19" are to be allocated at a main stopping point HH which comprises the floor "1" as a first main stopping floor and the floor "2" as a second main stopping floor. The main stopping point HH is approached by the double-deck elevator in such a manner that the lower car deck stops at the floor "1" and the upper car deck at the upper floor "2". The two main stopping floors "1" and "2" are connected by an escalator or the like, as is explained in more detail hereinafter.

In the case of the solution according to the state of the art (FIG. 2A) the passengers with the destination floors "11" and "19" get into the lower car deck and those with the destination floors "12" and "18" into the upper car deck. The elevator then stops at "11/12", wherein the two passengers with the destination floors "11" and "12" can disembark simultaneously. Thereafter the elevator travels to the position "17/18" in order to let the passenger with the destination floor "18" in the upper car deck disembark. A further short travel, which is conducted to the position "18/19", is necessary in order to transport the passenger in the lower car deck to his or her destination floor "19".

Figure 3:
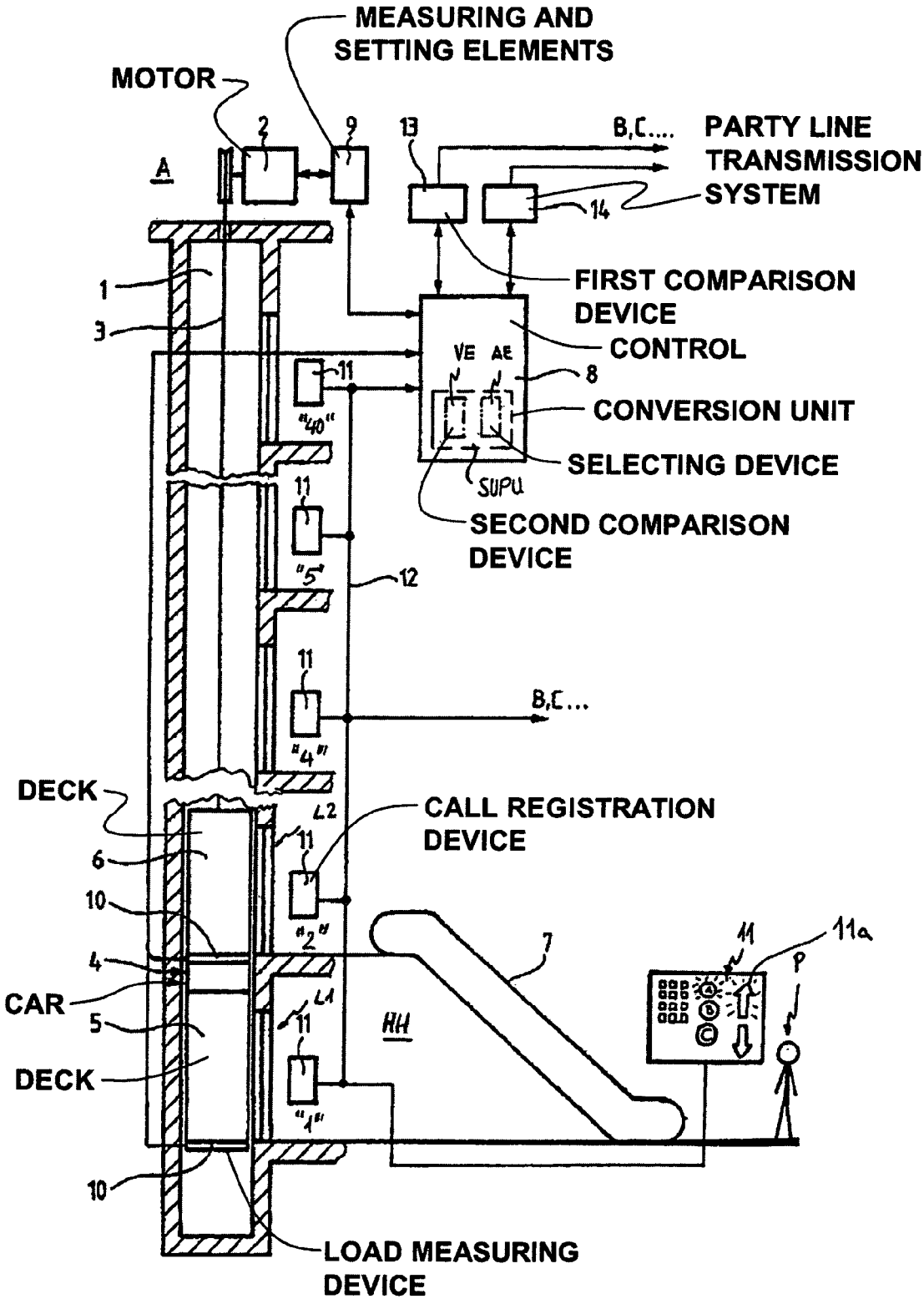
FIG. 3 is a schematic illustration of an embodiment of an elevator control according to the present invention for an elevator of an elevator group with double-deck cars.

In FIG. 2B there are shown the possible stops of an elevator installation with a double car which corresponds with the elevator car of FIG. 2A and is to execute the same travel orders, but the control of which is provided with a conversion unit SUPU (FIG. 3). This conversion unit dynamically allocates the passengers, who register their destination floor at the main stopping point HH by way of a destination call registration device 11 (FIG. 3), in correspondence with the travel orders already assigned to the double car 4, wherein the possible allocations are compared with respect to which allocation in the succeeding journey gives the minimum stopping halts.

The conversion unit SUPU optimizes the allocation of the passengers to the individual car decks on the basis of the call situation supplied by the control module of the selected elevator. In this case the passengers with the destination floors "11" and "18" are conveyed in the lower car deck and the passengers with the destination floors "12" and "19" are conveyed in the upper car deck. Thus, only two stops at the positions "11/12" and "18/19" are necessary in order to transport all passengers to their destinations.

The advantages of the solution with the conversion unit SUPU (FIG. 2B) are apparent by a comparison with the previous double-deck controls with the so-termed "restricted service" (illustrated in FIG. 2A), as are known from, for example, EP 0 301 178 or also U.S. Pat. No. 5,086,883. Express reference is made to both specifications for more specific details of equipping, by way of example, in terms of hardware, of the elevator installation coming into question here.

By comparison of the two illustrations according to FIGS. 2A and 2B it is clear that the use of the conversion unit SUPU can reduce the number of stops per round journey.

A concrete example of an embodiment of an elevator installation, which serves the building according to FIG. 1, with a control is illustrated in FIG. 3.

The elevator shaft 1 for an elevator A or an elevator group consisting of several elevators is illustrated in FIG. 3. A hoisting drive motor 2 drives, by way of a conveying cable 3, the double car 4 which is guided in the elevator shaft 1 and has the two car decks 5, 6 arranged in a common car frame. It may be assumed that the illustrated elevator installation is disposed in the building, which is indicated entirely at the left in FIG. 1, with forty-one floors and serves, with interposition of blind zones BZ (not illustrated in FIG. 3), only a part of these floors of the building.

The spacing of the two car decks 5, 6 from one another is so selected that it corresponds with the spacing of two adjacent floors. If there are one or more taller floors, the control device must take that spacing into consideration. The main stopping point HH present at the ground floor has in the floor "1" a lower access L1 to the lower car deck 5 and in the floor "2" an upper access L2 to the upper car deck 6 of the double car 4. The two accesses L1, L2 are connected together by an escalator 7.

The hoisting drive motor 2 is controlled by, for example, a drive control known in principle from the patent EP 0 026 406, wherein the target value generation, regulating function and stop initiation are carried out by means of a control device 8 which is constructed as a microcomputer system. The control device 8 is connected with measuring and setting elements 9 of the drive control. The control device 8 can also take over still further tasks, as is described in detail and illustrated in the U.S. Pat. No. 5,086.883. For example, also load measuring devices 10 are connected with the control device 8.

The call registration devices 11, which are, for example, known from the patent EP 0 320 583 and which comprise decade keyboards, by means of which calls for journeys to desired destination floors can be input, are provided at the floors. As described in the U.S. Pat. No. 5,086,883 these are connected by a data conductor 12 with the control device 8. The control devices 8 of the individual elevators of the group are connected together by way of a first comparison device 13 known from EP 0 050 304 and a party-line transmission system 14 known from EP 0 050 305.

The conversion unit SUPU, which in the case of the control of the elevator installation leads to a minimization of the stops for a journey starting from the main stopping point HH, is formed in the control unit 8 by software modules. The conversion unit SUPU comprises a second comparison device VE and a selecting device AE.

The corresponding call registration device 11 is disposed at the main stopping point HH at, for example, a region in front of the escalator 7 where the paths to the two accesses L1 and L2 branch off from one another. Here a passenger P can input his or her desired destination floor by way of the decade keyboard. In the case of the elevator A there are then possible allocations of the passenger P to the upper car deck 6 or the lower car deck 5. These two allocations are compared, on the basis of travel orders already allocated to the individual car decks, with one another with respect to the then-necessary stops in the succeeding upward number. That allocation which gives the smallest number of stops is then selected by the selecting device AE and indicated to the passenger by way of an indicating device 11*a* of the call registration device 11. In the illustrated example an upwardly pointing arrow for the upper car deck 6 illuminates.

In the case of the comparison of the elevator stops to be undertaken by a specific allocation, those already allocated to the individual car decks of the elevators A, B, C . . . and the building structure, as it is apparent from FIG. 1, are taken into consideration. For this purpose in the comparison device it is calculated for a specific allocation at which of the stopping positions HPA "1" to "16" the elevator car 4 has to stop for this allocation. The corresponding stops are counted and compared with the correspondingly ascertained stops for the remaining allocations. Then that allocation which gives the smallest number of overall stops is selected by the selecting device AE and indicated to the passenger P by the indicating device 11. According to that a lamp "A" for the elevator A illuminates at the device 11 in the example illustrated here. Clearly, a choice minimizing stops is to allocate to the passenger a car deck that already must stop at the passenger's destination floor to embark or disembark another passenger. If that choice is not available, another choice is to allocate to the passenger a car deck that already must stop at the passenger's destination floor due to an allocated stop of another car deck to embark or disembark another passenger.

The journey following the allocation and boarding of the passenger P is then carried out in correspondence with the effected allocation with the minimized number of stops.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A control device for controlling an elevator installation with a multiple deck car that simultaneously serves several floors of a building with one stop, the car having at least two car decks that are accessible at the same time at a main stopping point by way of different associated main stopping floors, the elevator installation further including a call registering device at the main stopping point by which a passenger can input a destination call representing his or her travel order for a desired destination floor, comprising:

a conversion unit adapted to be connected to the call registering device, said conversion unit responding to a destination call input by a passenger at the main stopping point and to destination floor travel orders already allocated to and/or demanded of the multiple deck car to ascertain which car deck of the multiple deck car is to be allocated to the passenger at the main stopping point in order to minimize the number of stops to be made by the multiple deck car; and an indicating device connected to said conversion unit and being responsive to the ascertained car deck to indicate to the passenger at the main stopping point the main stopping floor associated with the allocated car deck.

2. The control device according to claim 1 wherein said conversion unit further responds to a structure of the building, including different spacings between floors to be served by the multiple deck car, to ascertain which car deck is to be allocated.

3. The control device according to claim 2 wherein said conversion unit ascertains the car deck which is to be allocated in dependence on distances between the destination floors to be served.

4. The control device according to claim 1 wherein said conversion unit considers at which stop of the multiple car one of the car decks did not come to a stop at a floor previously directly served by the elevator installation and carries out the allocation in such a manner that the number of such stops is minimized.

5. The control device according to claim 2 wherein said conversion unit ascertains the car deck which is to be allocated to a destination call at the main stopping point dynamically on the basis of all destination calls registered or demanded at the main stopping point for this elevator and/or on the basis of destination calls registered or demanded at the entire elevator installation without consideration of whether a floor, the number of which is divisible by the number of car decks of the multiple car, was driven to by a car deck at each stop.

6. The control device according to claim 1 wherein the multiple deck car has two car decks and said conversion unit allocates to each of the car decks passengers with even and uneven numbered destination floors in order to minimize the number of stops.

7. The control device according to claim 1 including a call registration device adapted to be located at a main stopping point of the elevator installation, said call registration device including said indicating device.

8. The control device according to claim 1 wherein the elevator installation has a plurality of elevators and said conversion unit ascertains a one of the elevators and an associated deck to be allocated in dependence on the divisibility of a number of the destination floor by the deck number such that the number of overall stops is minimized and said indicating device indicates the allocated elevator and the allocated car deck and/or the main stopping floor from which the allocated car deck is accessible.

9. The control device according to claim 1 wherein said conversion unit includes a comparison device that compares possible allocations of the destination call to the car decks as to whether a specific allocation with consideration of travel orders already allocated to the multiple car gives by comparison to another allocation a lesser number of stops in the case of travel, which starts subsequently from the main stopping point, for execution of the travel orders allocated to the multiple car.

10. The control device according to claim 9 wherein said conversion unit includes a selecting device which responds to a comparison of two possible allocations by said comparison device to select that allocation which gives the lesser number of stops.

11. A method of controlling an elevator installation with a multiple deck car for simultaneously serving more than one floor by one stop, wherein a main stopping point with different main stopping floors is driven to in normal operation in such a manner that each car deck of the multiple deck car stops at a main stopping floor, wherein destination calls of passengers are registered at the main stopping point, comprising the steps of:

a) registering a destination call at the main stopping point;

b) allocating the destination call to one of the car decks in dependence on all the destination calls registered at the main stopping point and/or in dependence on destination calls registered at other floors and/or in dependence on the structure of the building; and c) indicating to the passenger at the main stopping point the allocated car deck and/or an associated allocated main stopping floor wherein when the elevator installation includes several multiple deck elevators, said indicating step is performed by displaying to the passenger both the allocated car deck and the associated allocated main stopping floor.

12. The method according to claim 11 wherein said step b) is performed dynamically without consideration of the divisibility of the number of the destination floor by the number of the car deck of the multiple deck car.

13. The method according to claim 11 wherein immediately after performing said step b), performing a step of indicating to the passenger at the main stopping point the allocated elevator and the car deck thereof or the corresponding main stopping floor.

14. The method according to claim 11 said step b) is performed in accordance with whether a specific allocation with consideration of travel orders already allocated to the multiple deck car results in a smaller number of stops relative to another allocation in the case of travel which starts subsequently from the main stopping point.

15. A method of controlling an elevator installation with at least two multiple deck cars for simultaneously serving more than one floor by one stop, wherein a main stopping point with different main stopping floors is driven to in normal operation in such a manner that each car deck of the multiple deck cars stops at one of the main stopping floors, wherein destination calls of passengers are registered at the main stopping point, comprising the steps of:

a) registering a destination call at the main stopping point entered by a passenger;

b) allocating the destination call to one of the car decks in dependence on all the destination calls registered at the main stopping point and/or in dependence on destination calls registered at other floors and/or in dependence on the structure of the building; and c) displaying to the passenger at the main stopping point the main stopping floor associated with the allocated car deck.

16. The method according to claim 15 wherein said step b) is performed dynamically without consideration of the divisibility of the number of the destination floor by the number of the car deck of the multiple deck car.

17. The method according to claim 15 wherein immediately after performing said step b), performing a step of indicating to the passenger at the main stopping point the allocated elevator and the car deck thereof or the corresponding main stopping floor.

18. The method according to claim 15 said step b) is performed in accordance with whether a specific allocation with consideration of travel orders already allocated to the multiple deck car results in a smaller number of stops relative to another allocation in the case of travel which starts subsequently from the main stopping point.

* * * * *